United States Patent [19]

Batten

[11] Patent Number: 4,617,844

[45] Date of Patent: Oct. 21, 1986

[54] REMOVABLE KEY FOR WRENCHING TOOL

[75] Inventor: Ronald W. Batten, Torrance, Calif.

[73] Assignee: VSI Corporation, Pasadena, Calif.

[21] Appl. No.: 702,959

[22] Filed: Feb. 19, 1985

Related U.S. Application Data

[63] Continuation-in-part of Ser. No. 514,783, Jul. 18, 1983, Pat. No. 4,538,483.

[51] Int. Cl.[4] ..... B25B 13/48; B25B 15/00

[52] U.S. Cl. ..... 81/436; 81/56; 403/298; 403/359; 403/383

[58] Field of Search ..... 81/55, 56, 436; 403/298, 356, 359, 383

[56] References Cited

U.S. PATENT DOCUMENTS

| | | | |
|---|---|---|---|
| 2,239,072 | 4/1941 | Adams | 81/55 |
| 2,726,091 | 12/1955 | Topar | 81/436 X |
| 2,789,597 | 4/1957 | La Torre | 81/55 |
| 3,156,142 | 11/1964 | Finkle | 81/57.37 |
| 3,323,394 | 6/1967 | Bangerter et al. | 81/464 |
| 3,416,582 | 12/1968 | Jenks | 81/436 X |
| 3,584,527 | 6/1971 | Bosten | 81/56 |
| 3,990,550 | 11/1976 | Recker | 403/359 X |
| 4,289,414 | 9/1981 | Recker | 403/12 |
| 4,462,281 | 7/1984 | Zils | 81/56 |

FOREIGN PATENT DOCUMENTS

| | | | |
|---|---|---|---|
| 2345454 | 3/1975 | Fed. Rep. of Germany | 81/436 |
| 3200367 | 7/1982 | Fed. Rep. of Germany | 81/55 |

*Primary Examiner*—Howard N. Goldberg
*Assistant Examiner*—Ronald S. Wallace
*Attorney, Agent, or Firm*—Plante Strauss & Vanderburgh

[57] ABSTRACT

There is disclosed a removable torque-transmitting body, such as a key and methods for securing the key in, and releasing it from, a power assisted wrenching tool for the attachment of fasteners, particularly frangible fasteners, in loose and interference fit applications. The key has a main shaft portion with a distal, torque-transmitting head at one end, and an opposite end of reduced thickness and non-circular cross section, with a transverse groove therebetween. The wrenching tool has a subassembly of an outer socket member and an elongated key holder slidably mounted therein, under spring resistance, with a ball detent mounted in a cross bore in the key holder. The reduced thickness end of the key is inserted into the receiving keyway of the holder, and an axial force can be applied to seat the key, with the detent ball received in its transverse groove. Alternatively, the cross bore in the key holder can be aligned with a ball receptacle in the outer socket member, the spring resistance on the holder disengaged, and the key is then slipped into the key holder, and the spring resistance is released to lock the key in its holder. Once the ball is seated in the transverse groove of the key, the key cannot be extracted until the holder is aligned in its ball releasing position and the spring resistance on the holder is disengaged.

14 Claims, 15 Drawing Figures

REMOVABLE KEY FOR WRENCHING TOOL

REFERENCE TO RELATED APPLICATIONS

This application is a continuation-in-part of copending application, Ser. No. 514,783, filed July 18, 1983, now U.S. Pat. No. 4,538,483, issued Sept. 3, 1985.

BACKGROUND OF THE INVENTION

1. Field Of The Invention

This invention relates to a removable key for a wrenching tool, and in particular, to a key for use in a wrenching tool for attachment of frangible fasteners.

2. Brief Statement Of The Prior Art

Frangible fasteners are used extensively in the aerospace industry. These fasteners employ a threaded nut member which has a threaded collar and a distal wrenching ring separated by a notched section that shears from the collar when the applied torque exceeds a predetermined torsional loading. Often the threaded collar has an upset portion, usually a slightly elliptical shape, to provide a frictional spring lock to prevent the fastener from spinning off in the event that the residual tension on the fastener is lost.

These fasteners are applied with wrenching tools which have a center key that is inserted into a broached keyway of the fastener bolt to immobilize the bolt onto which the collar is applied. Typically the key is slidably mounted in the wrenching tool concentric with the driven, outer, socket member. Usually the key is fixed in the tool with a set screw, however, some tools, such as shown in U.S. Pat. No. 3,584,527, permit the key to be inserted from the rear of the tool through a port closed with a removable retainer plate. In U.S. Pat. No. 2,239,072, a tool is illustrated in which the key is retained with a ball detent which has a clamp ring that secures the detecting ball in a groove about the shaft of the key. All of these prior devices have required a partial disassembly of the tool to remove or change keys.

The attachment of keys in the prior tools is cumbersome and causes delays and difficulties in changing the tools between applications of fasteners in interference fits and loose fits, since only in the latter instances is a key necessary. It is often necessary to replace broke and worn keys, and this is a time consuming operation in the prior tools which must be partially disassembled to release the key. A key occasionally jams in a bolt, which immobilizes the tool, and difficulties are usually experienced in attempting to release the key from the tool.

BRIEF DESCRIPTION OF THE INVENTION

This invention comprises a torque-transmitting body, more particularly a key, and methods for its use with a wrenching tool. The tool has a subassembly of an outer socket member and an elongated key holder slidably mounted therein under spring resistance. A keyway is formed by a center bore in the key holder which is broached to a non-circular cross-section conforming to the shape of the key, and a cross bore is also provided in the holder to form a receptacle which receives a detent member, such as a detent ball. A recess is provided in the outer socket member to receive the ball detent when inserting or removing the key.

The key has a main shaft portion with a distal, torque-transmitting head and, at its opposite end, has a reduced thickness and a non-circular cross section which indexes in the receiving keyway of the holder. A transverse groove is provided in the key to seat the detent ball between its reduced thickness end and the main shaft portion. Preferably, the key has stop means such as a shoulder which limits its axial displacement in said receiving keyway when the detent ball is seated in the transverse groove of the key.

The reduced thickness end of the key can be placed in the holder and an axial force applied to insert the key fully and seat the ball in its transverse groove. Alternatively, the holder can be aligned with its cross bore opposite the ball recess in the outer socket member, the spring resistance disengaged, and the key can then be slipped into the holder, and the sring resistance released to lock the key in the holder.

Once the key has been inserted in the holder, and the detent ball seated in its transverse groove, it can be extracted only by releasing the detent ball, a procedure which requires that the holder be aligned with the ball opposite the ball recess in the outer socket member and immobilized against the spring bias in this position, preferably with a spacer block which can be a attached to the tool.

BRIEF DESCRIPTION OF THE DRAWINGS

The invention will be described with reference to the figures, of which.

DESCRIPTION OF THE PREFERRED EMBODIMENT

Figure 1:
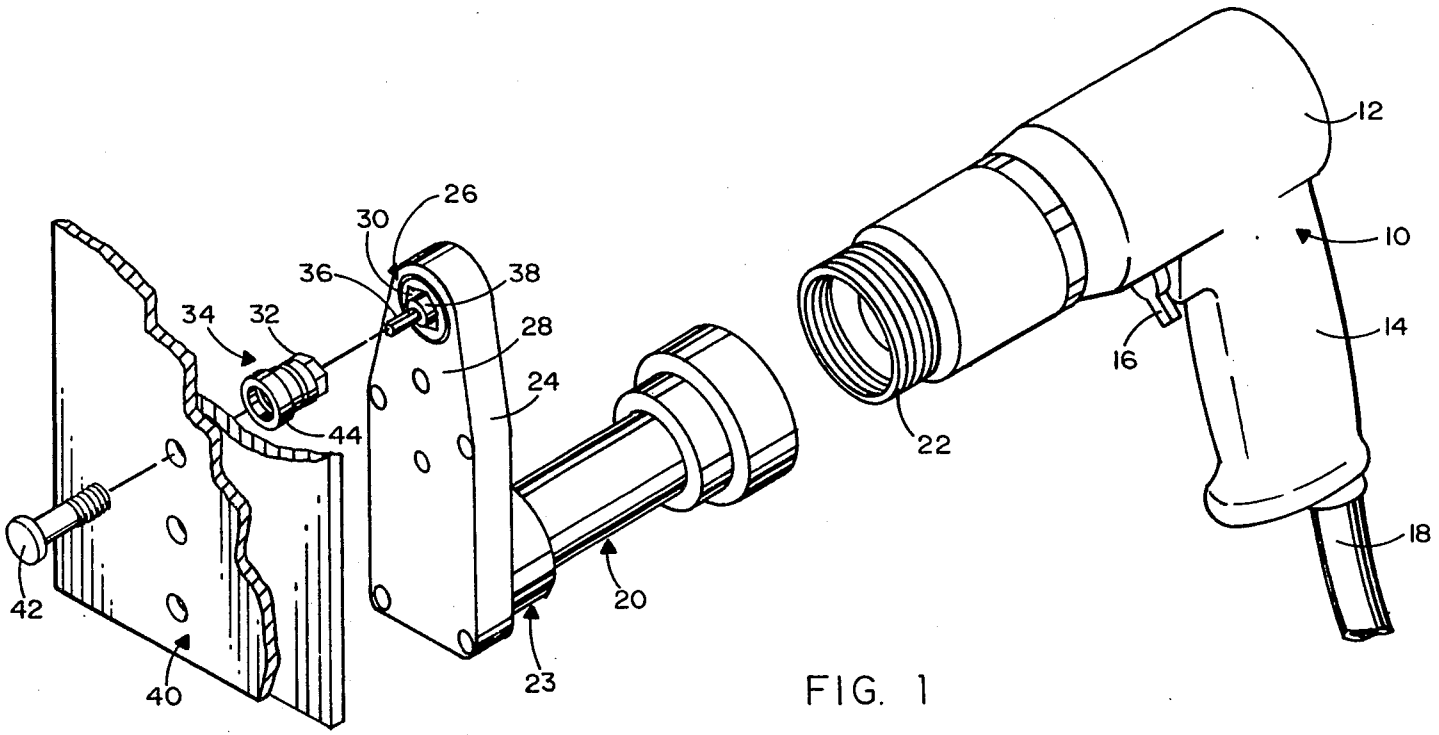
FIG. 1 is an exploded perspective view of the wrenching tool.

Referring now to FIG. 1, the invention is shown as employed in an otherwise conventional wrenching tool. The wrenching tool incluses a motor assembly 10 with a motor housing 12 and an integral, dependent hand grip 14 having a trigger 16. The motor assembly 10 is supplied with a motive fluid, commonly compressed air, through a flexible hose 18. The particularly illustrated wrenching tool includes a torque control assembly 20 which is threadably engaged on the threaded boss 22 of the housing 12 and which has an internal shaft, not shown, that is connected to the motor drive shaft. The torque control assembly 20 contains an internal friction clutch which is preloaded to a predetermined torque and this assembly is commonly used with the non-frangible fasteners to provide a control on the tightening torque applied to the fasteners. It is not needed when the tool is to be used with frangible fasteners.

The torque control assembly is attached to the tool head assembly 23. This head assembly has a housing 24 which contains a plurality of gears that provide a gear train with the appropriate speed reduction characteristic for the particular tool. At its upper end, the head assembly 23 supports a socket assembly 24. A number of interchangeable socket assemblies can be used to provide a variable extension from the face 28 of the head assembly housing 24. The particular socket assembly illustrated is flush with this plate and receives in its socket 30, the wrenching ring 32 of a frangible fastener 34. The socket assembly is also illustrated with the key 36 of the invention restrained in the receiving keyway of the holder member 38. The workpiece is generally indicated at 40 and comprises two members to be retained by a bolt fastener 42 and a threaded collar fastener 44 of the frangible fastener unit.

Figure 2:
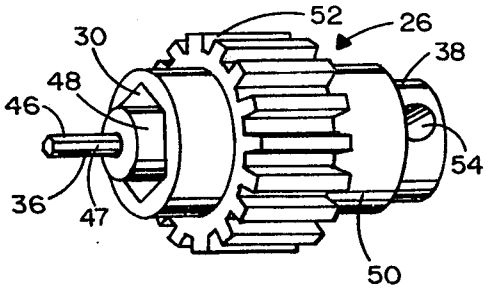
FIG. 2 is a perspective view of the socket subassembly of the wrenching tool.

Referring now to FIG. 2, there is illustrated the socket assembly 26 removed from the head assembly 23. The socket assembly comprises three major parts; the key 36, the holder member 38, and the outer, socket member 50. The key 36 has a main shaft portion 47 having one or more flats 46 and is received within a broached keyway concentric in the core 48 of the holder member 38. The holder member 38 is slidably received within a through bore of the outer, driven member 50 which has a plurality of sprocket gear teeth 52 about its periphery. These gear teeth 52 engage with gears within the head assembly 23. The forward end of the driven member 50 has a socket 30 for receiving the wrenching ring 32 previously mentioned with regard to FIG. 1. The holder member 38 has a transverse bore 54 which receives a spring retainer that restrains this member against rotation and biases it forward, towards the workpiece, while permitting its relative axial displacement within the driven member 50.

Figure 3:
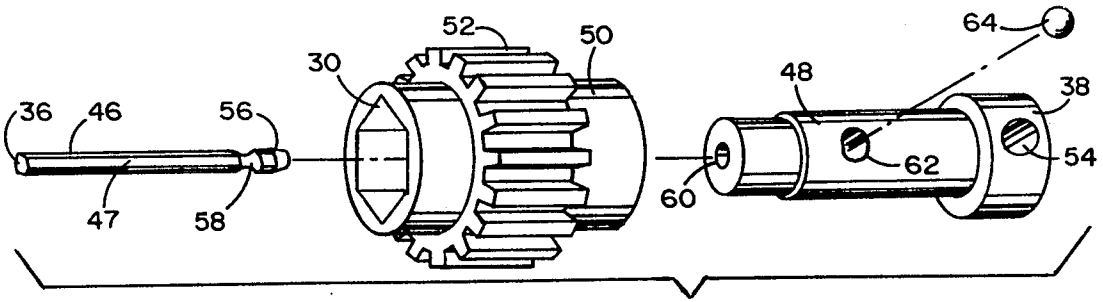
FIG. 3 is an exploded perspective view of the socket drive subassembly.

Referring now to FIG. 3, the socket assembly is shown in exploded view. As there illustrated, key 36 has flats 46 coextensive the length of its main shaft portion 47 with one end chamfered at 56 and with a peripheral groove adjacent the chamfererd end. The aforementioned sprocket gear teeth 52 preferably are integral with the driven member 50 and this member has a socket end 30 which is in communication with a through bore, not shown, having a sufficient inside diameter to slideably receive the central core 48 of the holder member 38. The holder member 38 has a center keyway 60 which is formed by a bore that is broached to provide flated surfaces which mate the flatted surfaces 46 of key 36. Intermediate its length, the holder member has a cross bore 62 which intersects the longitudinal keyway 60. This cross bore 62 is of sufficient diameter to receive the ball 64 which serves as a detent member, cooperatively engaging the groove 58 of the key 36.

Figure 4:
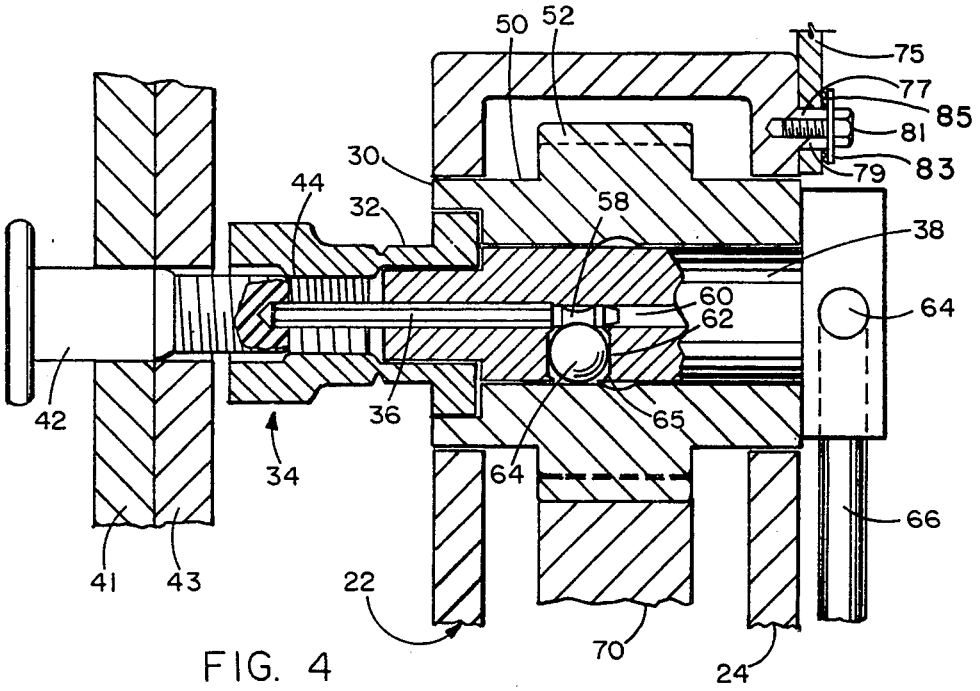
FIG. 4 is an elevational sectional view illustrating the application of a frangible fastener to a bolt with the wrenching tool of the invention.

Referring now to FIG. 4, the wrenching tool and fastener system is shown in greater detail. As there illustrated, the bolt 42 is shown in a loose fit extending through plates 41 and 43 and with its threaded end entering into the internally threaded fastener collar 44. The wrenching ring 32 at the opposite end of the frangible fastener 34 is shown engaged in the socket 30 of the driven member 50. The holder unit 38 is shown in its fully extended position and the key 36 is shown restrained by the ball 64 that is received in the cross bore 62 and projects into the central keyway 60 of the holder member 38. Preferably, ball 64 is captured in cross bore 62 by staked means such as a distal annular lip 65 on the inside wall of cross bore 62. The key 36 is secured by ball 64 which seats in the peripheral groove 58 of the key. The ball 64 is held in this position by the driven member 50, surrounding the holder member 38. The driven member 50 is illustrated with its sprocket gear teeth 52 meshed with the drive teeth of a driving sprocket gear 70 contained within the housing 24 of the head assembly 23. The holder member 38 is restrained against rotation in this assembly by the end of spring 66 which extends into the cross bore 64, all as previously described.

Figure 5:
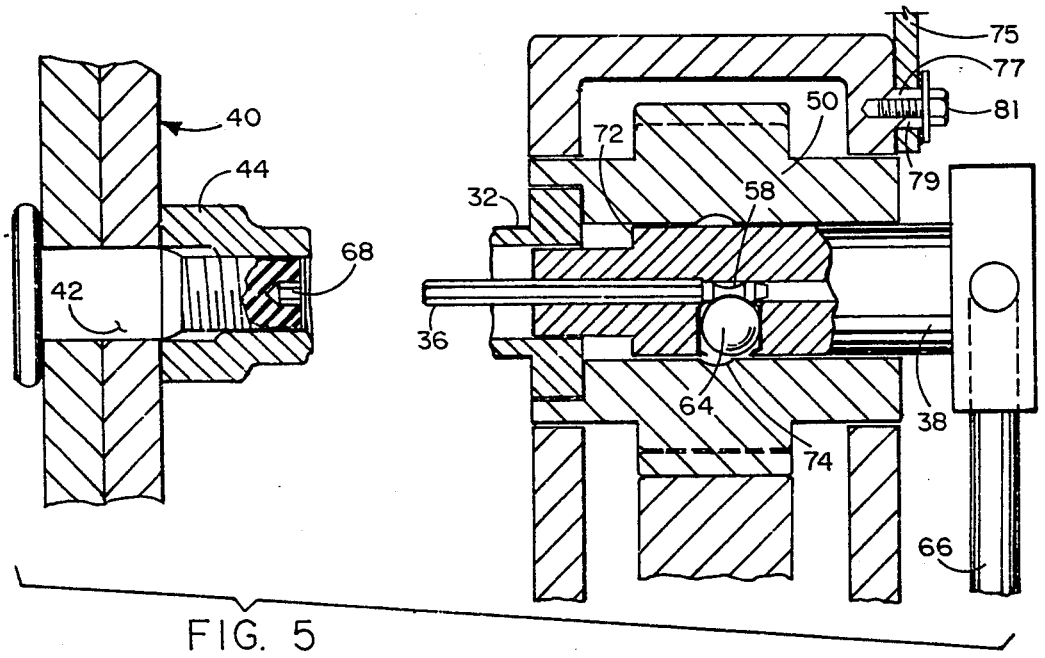
FIG. 5 is an elevational sectional view illustrating the tool and wrenching collar separated from the fastener system.

FIG. 5 illustrates the wrenching tool immediately upon separation of the frangible wrenching ring 32 from the fastener collar 44. This occurs when the fastening collar is advanced sufficiently on bolt 42 to achieve a predetermined tension in bolt 42, compressing the workpiece 40. The wrenching tool is retracted from the work, extracting the key 36 from the broached keyway 68 in the end of bolt 42. As the wrenching tool is retracted, spring 66 resiliently biases the holder member 38 towards the workpiece, advancing this unit until the shoulder 72 abuts the wrenching ring 32 and ejects this ring from the socket.

As the holder member 38 moves to advance the ball 64 past the alignment with the annular groove 74 in the driven member 50, the ball 64 remains in its detenting position, securing the key 36 as this alignment is only a transient condition and spring 66 prevents sufficient time for the detent ball 64 to retract from its illustrated position engaging the groove 58 of key 36. Also, with most uses, there is no retraction force applied to key 36, and no lateral force is transmitted to the ball 64 to cause it to move into the lateral recess, annular groove 74, during its transient condition when it is aligned with the lateral recess.

Figure 6:
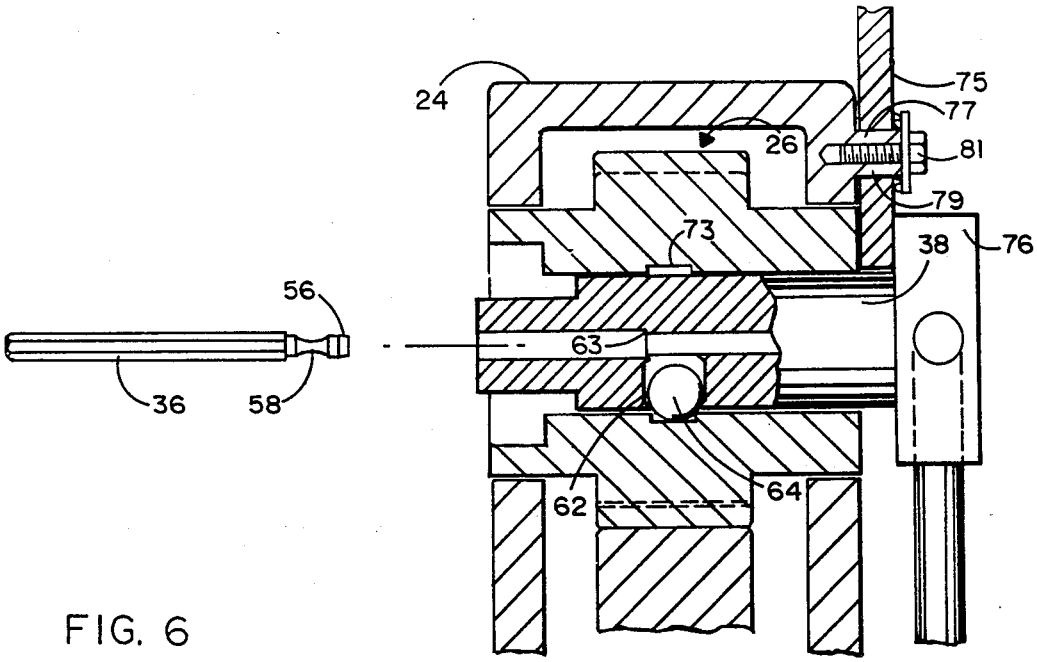
FIG. 6 illustrates the retraction of a key from the wrenching tool of the invention.
Figure 7:
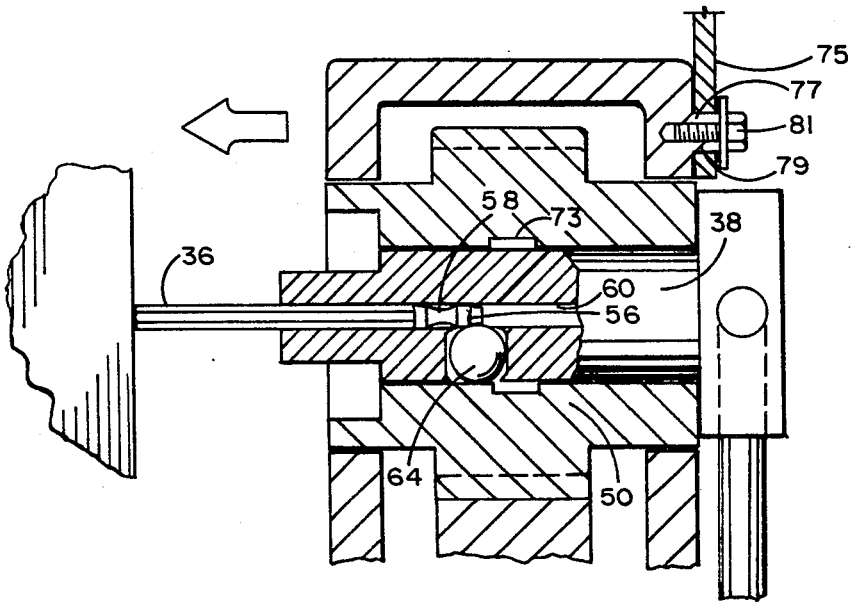
FIG. 7 is an elevational view illustrating insertion of the key into the tool.

The key 36 can be readily extracted from the socket assembly 26 in the manner shown in FIG. 6. The embodiment shown in FIGS. 6 & 7 is substantially the same as previously described, except the annular groove in the outer socket member 26 has a rectancular, rather than arcuate, cross section. As there illustrated, the annular groove 73 is positioned in exact alignment with the cross bore 62 of the holder member 38, permitting ball 64 to move laterally, retracting the ball from its engagement with groove 58 in the end of key 36. This frees key 36 for extraction from the assembly, as shown in FIG. 6. With the key removed, shoulder 63 is visible in receiving keyway 60 which provides an abutment stop for key 36. The annular groove 74 can be aligned with cross bore 62, and the bias of spring 66 can be released from holder 38 in the aligned position by placing a spacer block 75 between the back of housing 24 of the head assembly and the head 76 of the holder member 38. If desired, the spacer block can be permanently attacted to the tool by a cylindrical boss 77 which is received in bore 79 of spacer block 75. A machine screw 81 is threaded into the boss 77 on housing 24 and washer 83 and spring washer 85 are placed over the spacer block 75 to permit it to be swung into the illustrated position when needed and retained to one side when the tool is in use.

One feature of the invention is that the key 36 can be set in the socket assembly in its restrained position within holder 38 by forcefully advancing the key 36 in the manner illustrated in FIG. 7. In this application, the ball 64 is in its inwardly displaced position, restrained therein by the driven member 50. The inboard end of key 36 encounters the ball and its inward movement is interfered by the ball. The key, however, has adequate resiliency to flex sufficiently to permit its head end to advance past the ball 64. For this purpose, the head end of key 36 is chamfered as shown at 56 at an angle of 10 to about 65 degrees, preferably 45 degrees, with its longitudinal axis, and the peripheral groove 58 is located within a distance from 0.2 to about 0.5 times the diameter of ball 64. The head end of the key should have a length which is from 1.1 to about 1.3, preferably from 1.223 to about 1.243 times its thickness, to insure sufficient strength and flexibility. Additionally, there should be a slight tolerance in the fit between the key and its receiving keyway 60. Since this provides a facile and fast manner for seating the key 36 in the socket assembly, it constitutes a preferred embodiment of the key 36 for use in the invention.

Figure 8:
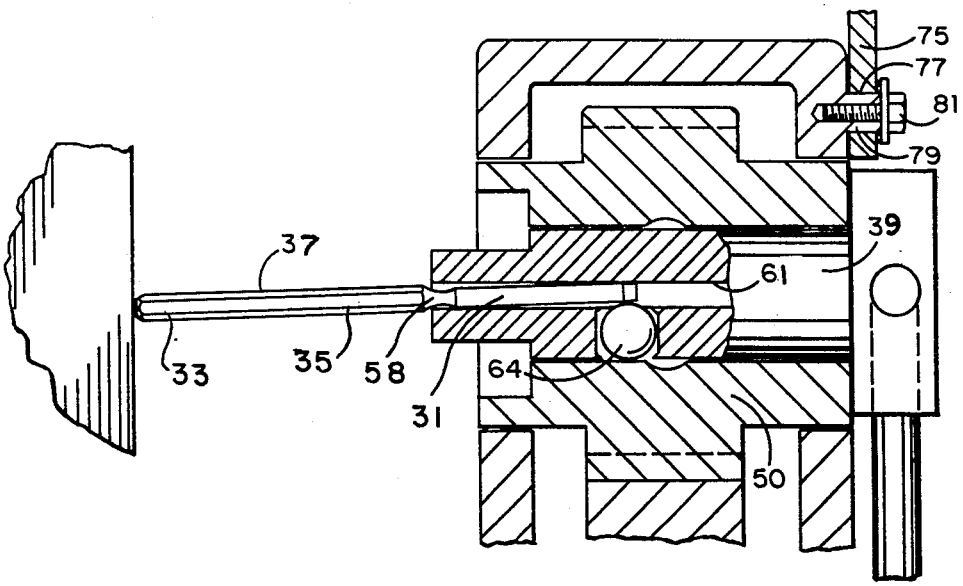
FIGS. 8–10 illustrate insertion of another embodiment of the key into a tool.
Figure 9:
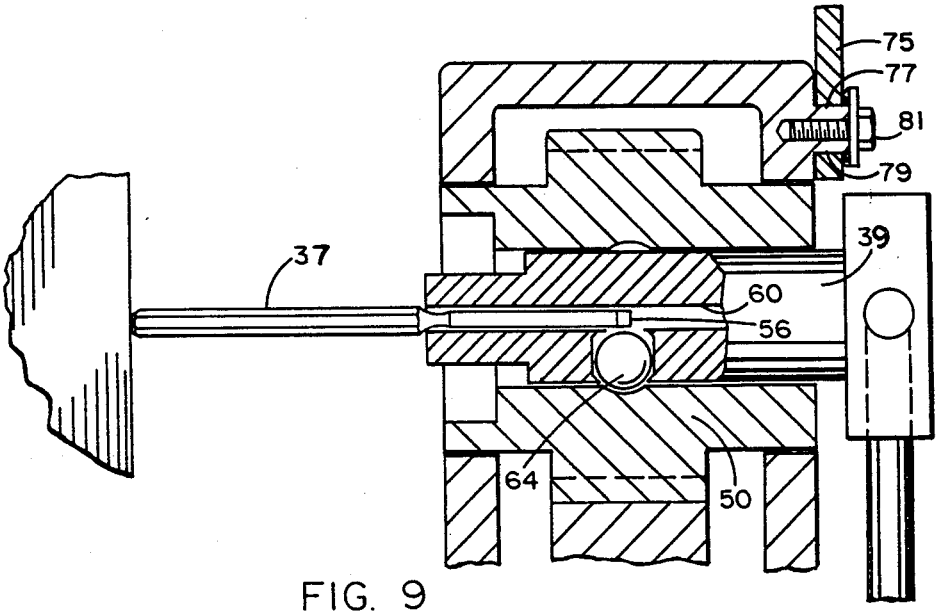
Figure 10:
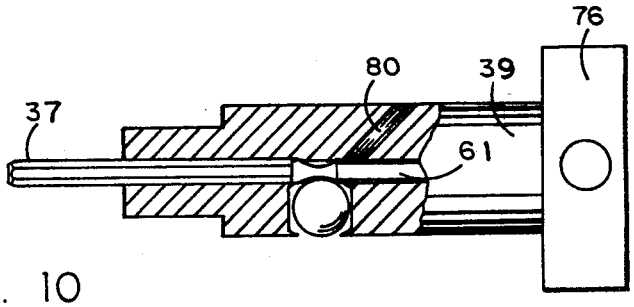

Another preferred structure of the key and the manner of seating the key in the tool of the invention is shown in FIGS. 8–10. As shown in FIG. 8, the preferred key 37 has a main shaft portion 35 with a distal, torque-transmitting head 33, and a non-circular, hexagonal cross section to index in the receiving keyway 61 of the holder 39. The opposite, or received, end 31 of the key 37 has a reduced thickness to permit it to be canted in the receiving keyway 61 and a sufficient length that it engages the ball 64 in its canted position. A transverse groove 58 is provided to seat the detent ball between the reduced thickness end 31 and the main shaft portion 35.

As the axial force is applied to the tool as shown in FIG. 9, the key, in its canted position, exerts sufficient frictional drag on holder 39 to slide the holder in the outer member 26 towards the ball releasing position. As shown in FIG. 9, the holder is in the ball releasing position, and the ball has been urged laterally outwardly by the end of key 37. Once the ball has moved outwardly sufficiently to pass the received end 31 of reduced thickness, the key will be forced past the ball until the end 58 of key 37 abuts the bottom of keyway 61 in holder 39. The end 31 of key 37 thereby provides the abutment stop to limit axial displacement of the key 37 in receiving keyway 61 when the detent ball is aligned with its transverse groove. At this position, the axial force applied to the key will also seat the ball in the transverse groove and free the holder for sliding movement in said outer member with said key positively interlocked therein. Once the key is inserted in this manner, it can be extracted only by releasing the detent ball, a procedure which requires the holder to be moved to align the ball with the ball recess in the outer socket member and immobilized in this position, preferably with the spacer block 75, previously described.

As shown in FIG. 10, the keyway 61 in the center of holder 39 is intersected with an angular bore 80 to permit insertion of a pin or other tool to clear keyway 61 of any jammed portion of key 37.

Figure 11:
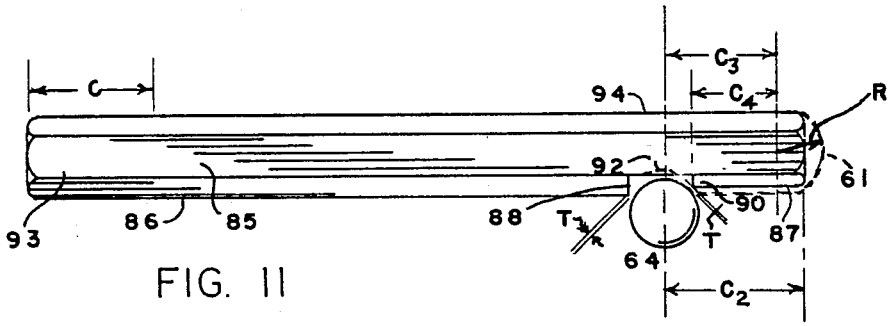
FIG. 11 illustrates the important design parameters of a preferred embodiment of the key.

FIG. 11 shows another, preferred embodiment of the key. The key 86 has a main shank portion 85 with a torque transmitting head 83 and reduced thickness at its opposite end 94, with a transverse square groove 88 on side 87. At its opposite end 81, key 86 is reduced, or flatted to a thickness less than the main shank portion 85 only on side, 87. The important design parameters of the key are shown in the illustration, with reference to the detent member, ball 64, and the receiving keyway 61 of the holder 38, shown in phanton lines. The detent ball 64 is shown in its seated position, where it restrains the key 86 in keyway 61. With a typical hexagonal fitting, the torque transmitting head 83 should have a length, C, which is from 50 to 75, preferably 67, percent of the basic diameter of the fastener. Preferably, the clearance, T, between the ball and the shoulders such as 90 of groove 88 is equal to or greater than 0.005 inch, and the clearance between the ball and the bottom surface of groove 88 is from 5 to about 10 percent of the diameter of the ball 64. If desired, the latter tolerance can be provided by milling an arcuate depression 92 in the center of the bottom of groove 88, directly beneath ball 64. The length of the reduced thickness end 83 beyond the center line of groove 88 should be sufficient that the end of the pin bears against the bottom of the keyway 61 in the holder 38. The relationship between these elements can be expressed mathematically, by a simple triangulation, as follows:

$$R = \sqrt{\left(\frac{1.1547}{2} \times C_5\right)^2 + C_2 - C_3\Big)^2}$$

wherein:

R is the radius of the bottom of keyway 61;

$C_2$ is the distance from the center of groove 88 to the end of the pin 86;

$C_3$ is the distance from the center of groove 88 to the center of radius R; and $C_5$ is the distance between parallel flats of the received end 94 of key 86, similar to a nominal diameter of the hexagonal end 94.

The key shown in FIG. 11 also can be inserted with an axial force. On initial engagement of the end 94 of the key 86 with the ball 64, the key will cause the holder to slide axially until its cross bore 62 is aligned with the annular groove of the outer socket member. In this aligned position, the ball moves into the annular groove, clearing the keyway and permitting full entry of the key until its forward end seats against the end of the keyway bore 61. At this position, the ball 64 also seats in transverse groove 88 of key 86, and the holder and key are interlocked. The holder and key will slide together without any lateral force being exerted on the ball 64, since the key is bottomed against the end wall of bore 61, causing the two to move together in one direction, and since spring 66 (shown in FIGS. 4 & 5) will cause the holder to move with the key in the opposite direction.

Figure 12:
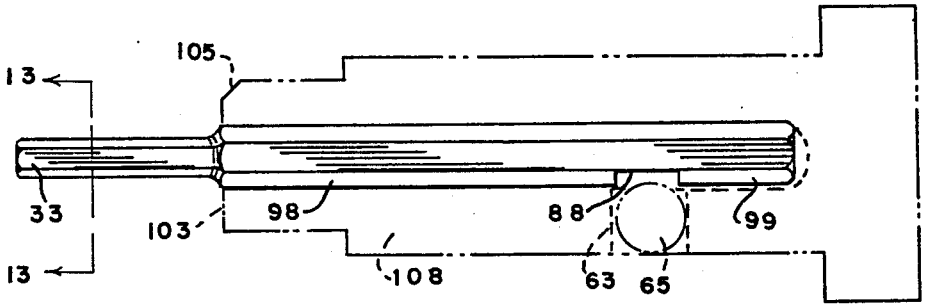
FIG. 12 is a view of another embodiment of the key with the holder and detent member shown in phantom lines.

Referring now to FIG. 12, a key 98 is shown as received in a holder 108, the latter illustrated in phantom lines. The key 98 has a torque-transmitting end 33 which has the appropriate dimensions for the particular fastener. The holder, however, has a receiving keyway 61 of standard dimensions, for a plurality of keys with torque-transmitting heads of various dimensions, thereby avoiding the necessity of changing holders when the key size is to be changed. Since the opposite end, 99, of the key is asymetrical, and has groove 88 only on one side 101 (as with the key described in FIG. 11), the holder is provided with an indexing indicia to identify the location of the detent member 65 and thereby inform the user of the correct orientation of the groove 88 when the key is inserted into the receiving keyway 61. This can be a mark scribed on the end 103 of the holder 108, or can be a groove 105 cut into the end 103 at a preselected angular relationship to the detent member, e.g., on the same side of holder 108 as the member 65, or, as illustrated, on the opposite side, at 180 degrees rotation from the detent member location. The detent member 65 is shown in FIG. 12 with a circular cross secton, and can be a ball, as previously described, or can be a cylinder. In the latter case, the detent member receptacle 63 is a slot with a rectangular or square cross-section, rather than the circular cross bore 62, previously described. Also, more than one detenting member, e.g., two, three, or more detent balls can be used, preferably spaced at equal angular increments about the periphery of the keyway. This construction is useful when it is desired to enhance the retention force of the key in the holder.

Figure 13:
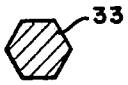
FIG. 13 is a sectional view along line 13—13 of FIG. 12.
Figure 14:
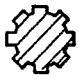
FIG. 14 is a sectional view of an alternative torque transmiting head for the key.

The torque-transmitting end 33 of the key 98 can have a variety of shapes, i.e., lengths and cross-sections, depending on the configuration of the work element such as a fastener. FIG. 13 illustrates the conventional hexagonal cross section of end 33 and this configuration has been described throughout this description. Other shapes, however, can be used such as a shape having a splined cross-section as shown in FIG. 14. Other shapes, such as the flat bladed, or Phillips bladed, screw driver can also be used. Also, the holder and key configuration of this invention can be adapted to the chuck of a drill, by using a twist drill configuration for the torque-transmitting head.

Figure 15:
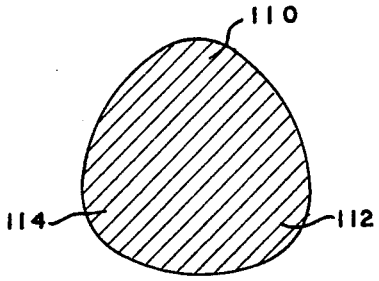
FIG. 15 is a sectional view of an alternative non-circular cross section useful for the key.

The key has also been illustrated throughout this description as having a hexagonal cross-section which indexes with the receiving keyway of the holder. Any non-circular cross-section can be used for this purpose, and a particular useful cross-section to index with a mating keyway in the holder is shown in FIG. 15, which shows three lobes 110, 112 and 114 having an arcuate shape.

The invention can also be adapted to provide a quick connect/disconnect coupling for flexible hoses in pneumatic or hydraulic service, similar to the Hansen quick disconnect coupling presently in use, but providing the advantage of single-handed operation. For this application, the holder and key described herein are replaced, respectively, by female and male, terminal hose connectors with the same operative elements such as the detent member, the spring, outer member, holder member and the transverse groove in the male connector to seat the detent member.

The invention has been described with reference to the presently preferred and illustrated embodiment. It is not intended that the invention be unduly limited by this disclosure of the presently preferred embodiment. Instead, it is intended that the invention be defined by the means, and their obvious equivilents, set forth in the following claims.

What is claimed is:

1. An elongated key for removable engagement in a tool having a tool subassembly of an outer member and an elongated key holder slidably received therein, a ball detent keyway formed by a receiving bore in said key holder and a detent ball receptacle intersecting said receiving bore with a detent ball seated in said receptacle and a ball recess in said outer member, said elongated key comprising:

a main shaft portion having a non-circular cross section to index in said receiving bore, a work end with a torque transmitting head;

an opposite end from said work end having a reduced thickness whereby said key may be canted in said receiving bore and having a sufficient length to engage said ball in its canted position; and a transverse groove between said opposite end and said main shaft portion; whereby said key, when inserted into said receiving bore, is operative to slide said holder to a position permitting said ball to be received in said ball recess of said outer member and permit passage of said opposite end past said ball, by the application of an axial force to the key.

2. The elongated key of claim 1 including stop means to limit axial displacement of said elongated key in said receiving bore when said transverse groove is aligned with said ball, whereby an axial force applied to said key will also seat said ball in said transverse groove and free said key holder for sliding movement in said outer member with said key positively interlocked therein.

3. The elongated key of claim 1 including a distal chamfer on the end of said key with said reduced cross section.

4. The elongated key of claim 1 including at least one longitudinal flat on said key to index in said receiving bore.

5. The elongated key of claim 1 wherein the main shaft portion thereof has a polygonal cross section.

6. The elongated key of claim 4 wherein the main shaft portion of said key has a hexagonal cross section.

7. The elongated key of claim 1 wherein said transverse groove is an annular groove extending entirely about said key.

8. An elongated key having a main shaft portion with a distal, torque-transmitting head, an opposite end having a reduced thickness and a length from 1.1 to about 1.3 times its thickness, a transverse groove therebetween, and an indexing portion of non-circular cross section.

9. The elongated key of claim 8 wherein said indexing portion comprises a non-circular cross section portion of said main shaft portion.

10. The elongated key of claim 9 wherein said index portion comprises at least one longitudinal flat on said main shaft portion.

11. The elongated key of claim 10 wherein the main shaft portion thereof has a polygonal cross section.

12. The elongated key of claim 11 wherein the main shaft portion of said key has a hexagonal cross section.

13. The elongated key of claim 9 including a distal chamfer on the end of said key with said reduced cross section.

14. The elongated key of claim 9 wherein said groove is an annular groove extending entirely about said key.

* * * * *